US005152339A

United States Patent [19]

Calleson

[11] Patent Number: 5,152,339

[45] Date of Patent: Oct. 6, 1992

[54] MANIFOLD ASSEMBLY FOR A PARALLEL FLOW HEAT EXCHANGER

[75] Inventor: Gerald C. Calleson, Wetumpka, Ala.

[73] Assignee: Thermal Components, Inc., Montgomery, Ala.

[21] Appl. No.: 762,563

[22] Filed: Sep. 19, 1991

Related U.S. Application Data

[63] Continuation-in-part of Ser. No. 503,798, Apr. 3, 1990, Pat. No. 5,107,926.

[51] Int. Cl.[5] ..... F28F 9/02

[52] U.S. Cl. ..... 165/173; 165/176

[58] Field of Search ..... 165/173, 174, 176

[56] References Cited

U.S. PATENT DOCUMENTS

| | | | |
|---|---|---|---|
| 1,856,618 | 5/1932 | Brown | 165/173 |
| 2,004,390 | 6/1935 | Benzinger | 165/174 |
| 2,178,895 | 10/1939 | Bowser | 165/174 |
| 2,434,988 | 1/1948 | Christensen | 165/149 |
| 2,573,161 | 10/1951 | Tadewald | 165/173 |
| 3,027,124 | 3/1962 | Albers et al. | 165/173 |
| 3,368,617 | 2/1968 | Rosman et al. | 165/175 |
| 3,472,316 | 10/1969 | Couch, Jr. | 165/153 |
| 3,724,537 | 4/1973 | Johnson | 165/133 |
| 3,858,647 | 1/1975 | Hickman et al. | 165/171 |
| 3,866,675 | 2/1975 | Bardon et al. | 165/173 |
| 3,960,208 | 6/1976 | Anthony et al. | 165/76 |
| 4,202,407 | 5/1980 | Woitowitz | 165/706 |
| 4,455,728 | 6/1984 | Hesse | 29/157.3 R |
| 4,531,578 | 3/1985 | Stay et al. | 165/175 |
| 4,569,390 | 2/1986 | Knowlton et al. | 165/149 |
| 4,600,051 | 7/1986 | Wehrman | 165/149 |
| 4,615,952 | 10/1986 | Knoll | 428/650 |
| 4,651,816 | 3/1987 | Struss et al. | 165/76 |
| 4,749,033 | 6/1988 | Clausen | 165/173 |
| 4,759,405 | 7/1988 | Metzger | 165/173 |
| 4,763,723 | 8/1988 | Granetzke | 165/67 |
| 4,825,941 | 5/1989 | Hoshino et al. | 165/110 |
| 4,829,780 | 5/1989 | Hughes et al. | 62/288 |
| 4,862,953 | 9/1989 | Granetzke et al. | 165/67 |
| 4,877,083 | 10/1989 | Saperstein | 165/176 |
| 4,936,381 | 6/1990 | Alley | 165/176 |
| 4,938,284 | 7/1990 | Howells | 165/149 |
| 4,960,169 | 10/1990 | Granetzke | 165/173 |
| 5,036,914 | 8/1991 | Nishishita et al. | 165/173 |

FOREIGN PATENT DOCUMENTS

| | | | |
|---|---|---|---|
| 540404 | 5/1957 | Canada | 165/173 |
| 55-112993 | 9/1980 | Japan | 165/173 |
| 1-224163 | 7/1989 | Japan | 228/183 |
| 944094 | 12/1963 | United Kingdom | 29/890.052 |
| 2049149A | 12/1980 | United Kingdom | 165/173 |
| 2090652A | 7/1982 | United Kingdom . | |

*Primary Examiner*—Allen J. Flanigan

*Attorney, Agent, or Firm*—Mason, Fenwick & Lawrence

[57] ABSTRACT

A manifold assembly for use with heat exchangers comprises an extruded unitary tank having a substantially U-shaped cross-section and a unitary stamped header plate which can either be substantially planar or have a substantially U-shaped cross-section. The longitudinal bottom edges of the tank are crimped around the longitudinal side edges of the header plate, and the mating surfaces are brazed substantially along their entire lengths. The inner wall of the tank can include opposed longitudinal ribs having opposed slots therein for receiving baffles for adjusting the flow path within the assembled manifold. The tank, header plate, and baffles are formed of aluminum and aluminum alloy materials suitable for furnace brazing, at least one of the mating surfaces being fabricated with a lower temperature clad brazing material, so that when the tank, header plate, baffles and heat exchanger tubes are assembled, fixtured, and brazed in a high temperature brazing furnace, the clad material provides the brazed material to braze the tubes to the header plate, the header plate to the tank, and the baffles to the tank and the header plate.

10 Claims, 4 Drawing Sheets

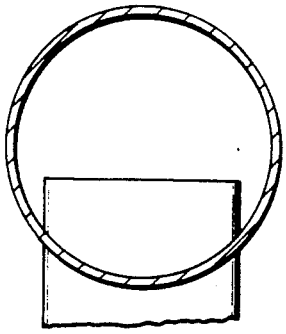
FIG. 1
PRIOR ART
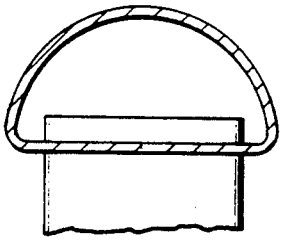
FIG. 2
PRIOR ART
FIG. 3
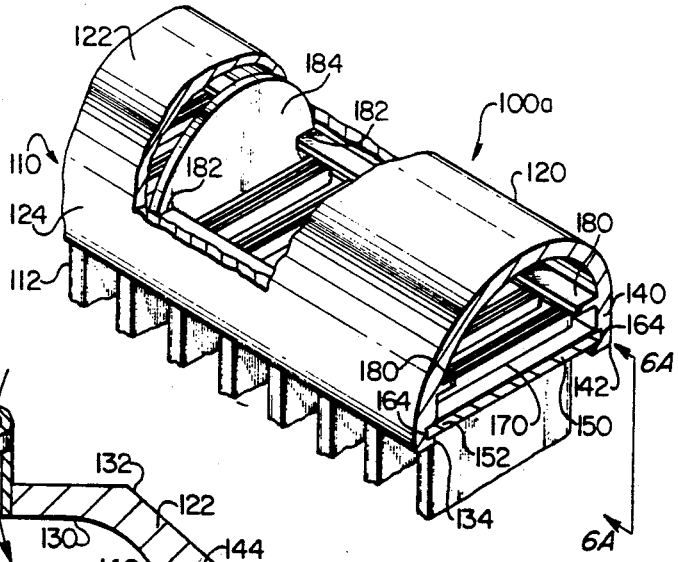
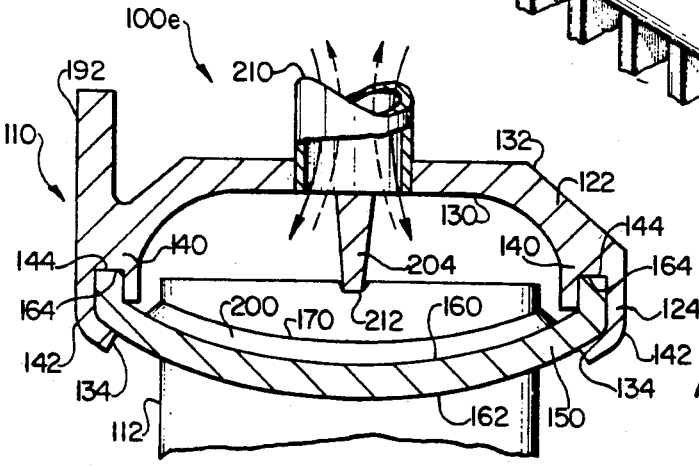
FIG. 9
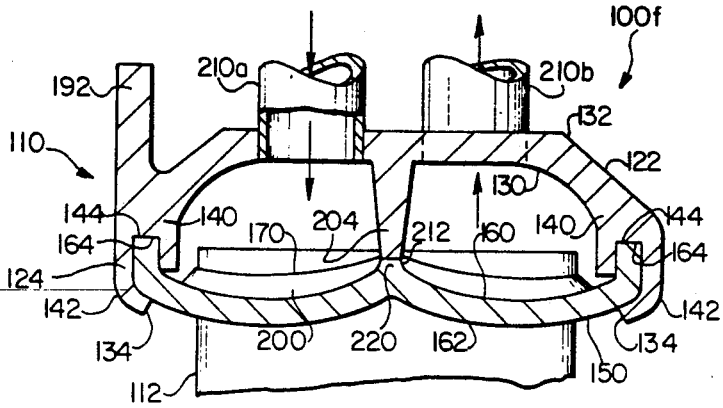
FIG. 10

MANIFOLD ASSEMBLY FOR A PARALLEL FLOW HEAT EXCHANGER

CROSS-REFERENCE TO RELATED APPLICATION

This application is a continuation-in-part of U.S. application Ser. No. 503,798, filed Apr. 3, 1990, U.S. Pat. No. 5,107,926.

BACKGROUND OF THE INVENTION

The present invention is directed to the field of manifold assemblies for use with heat exchangers, particularly heat exchangers for refrigeration applications.

Heat exchangers for refrigeration applications, particularly condensers and evaporators, are subjected to relatively high internal refrigerant pressure. Further, such heat exchangers cannot allow any leakage of refrigerant into the atmosphere and therefore preferably are designed with as few manufacturing connections as possible. Where manufacturing connections are necessary, their joints must be able to be manufactured economically and with a high probability that they will not leak.

Automotive condensers have typically been constructed with a single length of refrigerant tube, assembled in a serpentine configuration with an inlet at one end and an outlet at the other end. In some cases, two or more of such serpentine coils are assembled into an intertwined configuration so as to provide a multiple path flow of refrigerant across the air flow. The ends of the separate serpentine coils are connected to common manifolds. This concept of multiple path flow is extended to what is called a "parallel flow heat exchanger," in which all refrigerant tubes are straight and parallel to each other with the individual ends of these tubes connected to respective inlet and outlet manifolds. This configuration is commonly utilized in the construction of engine cooling radiators, oil coolers, and more recently, air conditioning condensers.

Condenser application to parallel flow has been more difficult to achieve in practice because of the need for multiple high pressure joints. Also, the atmospheric problems associated with release of standard refrigerants has necessitated the change to newer, more chlorinated refrigerants such as R-134A. The R-134A refrigerant is not as efficient as R-12 refrigerants, and also operates at higher pressure than R-12 refrigerants. The lower efficiency of the R-134A refrigerant requires a condenser design which not only is more efficient, such as a parallel flow design, but also is able to withstand higher internal operating pressures.

Manifolding multiple tubes to withstand high internal pressure can best be accomplished with a tubular manifold, the cross-section of which is circular for highest strength, as shown in FIG. 1. U.S. Pat. No. 4,825,941 to Hoshino et al. is an example of such a manifold with a circular cross-section. The chief disadvantage to the tubular manifold with a circular cross-section is the difficulty of piercing the series of holes in each manifold to receive the multiple parallel refrigerant tubes. Also, the tubular manifold with circular cross-section presents difficulties in assembly during manufacture. One partial solution to these problems is to flatten one side of each manifold tube as shown in FIG. 2, so as to provide a D-shaped cross-section which can more easily be pierced and subsequently assembled. However, insertion of the tubes into the manifold is still difficult. Also, in some heat exchanger designs, it is necessary to insert baffles in each manifold to create a multiple pass refrigerant flow. Insertion of the baffles into a tubular manifold can also present difficulties in assembly during manufacture.

Accordingly, it has been proposed to use a two-piece manifold comprising a tank and a header plate. In such a construction, the tank is provided with a flange, tabs are placed on the header plate, a gasket is inserted between the header plate and the tank, and the tabs are crimped over the tank flange. Examples of such a construction are shown in U.S. Pat. Nos. 4,455,728 to Hesse, 4,531,578 to Stay et al., and 4,600,051 to Wehrman. A leak-type seal is provided by compressing the gasket. However, compression of the gasket is not sufficient to seal the header plate and tank under the high pressures found in condensers. It is the solution of the above and other problems to which the present invention is directed.

SUMMARY OF THE INVENTION

Therefore, it is a primary object of this invention to provide a manifold assembly for heat exchangers which can withstand high internal operating pressures.

It is another object of the invention to provide a manifold assembly for heat exchangers which is easier and less costly to assemble.

These and other objects of the invention are achieved by the provision of a manifold assembly which comprises a unitary tank having a substantially U-shaped cross-section and a unitary header plate which can either be substantially planar or have a substantially U-shaped cross-section.

The tank comprises an at least partially curved upper portion which in cross-section forms the base of the U, a pair of substantially straight opposed, parallel sides extending from the ends of the upper portion and which in cross-section form the arms of the U, an inner wall, an outer wall, a pair of longitudinal end edges extending between the inner and outer walls at the free ends of the sides, and a pair of opposed parallel shelves formed in the inner wall inwardly of the end edges to define a pair of flanges extending from the shelves.

The header plate comprises a pair of opposed, parallel edge portions and a center portion extending between the edge portions, an upper wall, a lower wall, and a pair of longitudinal end edges extending between the upper and lower walls, the center portion having a plurality of tube holes formed therethrough along the center line for receiving the tubes of the condenser or evaporator. The shelves in the tank form stops against which the header plate abuts. The tank flanges are crimped inwardly to engage at least a portion of the edge portions of the header plate along the entire length of the header plate. Also, the tank and header plate are brazed together along substantially the entire lengths of their mating surfaces in order to provide both a mechanical and a metallurgical bond which provides the strengths to withstand high internal pressures.

The tank and header plate are formed of aluminum and aluminum alloy materials suitable for furnace brazing, at least one of the mating surfaces being fabricated with a lower temperature clad brazing material, so that when the tank, header plate, and tubes are assembled, fixtured, and brazed in a high temperature brazing furnace, the clad material provides the brazed material to braze the tubes to the header plate and the header plate to the tank.

In one aspect of the invention, the tank is formed by extrusion and the header plate is formed by stamping.

In another aspect of the invention, the tank is extruded from an aluminum alloy such as AA3003 or the like, and the header plate is fabricated from sheet aluminum of a desired based aluminum alloy such as AA3003 or the like, clad on both surfaces with aluminum alloy such as 4004 or any other suitable brazing alloy.

In still another aspect of the invention, a pair of opposed, longitudinally-extending horizontal ribs can be formed in the inner wall of the tank and provided with opposed slots to receive baffles, in order to adjust the flow pattern. The horizontal ribs can also serve as tube stops. The baffles are also formed of aluminum and aluminum alloy materials suitable for furnace brazing, so that when the manifold assembly is brazed in a high temperature brazing furnace, the baffles are brazed to the tank and the header plate.

In yet another aspect of the invention, a longitudinally-extending vertical rib can be provided in the inner wall to serve as a tube stop or to act as a continuous center separator which brazes to the center line of the header plate to provide a two pass heat exchanger.

A better understanding of the disclosed embodiments of the invention will be achieved when the accompanying detailed description is considered in conjunction with the appended drawings, in which like reference numerals are used for the same parts as illustrated in the different figures.

BRIEF DESCRIPTION OF THE DRAWINGS

FIG. 1 is a cross-sectional view of a first prior art manifold and heat exchanger assembly.

FIG. 2 is a cross-sectional view of a second prior art manifold and heat exchange assembly.

FIG. 3 is a perspective view, partially cut away, of a first embodiment of a manifold and heat exchanger assembly in accordance with the present invention.

FIG. 9 is a cross-sectional view of a fifth embodiment of a manifold and heat exchanger assembly in accordance with the present invention.

FIG. 10 is a cross-sectional view of a sixth embodiment of a manifold and heat exchanger assembly in accordance with the present invention.

DETAILED DESCRIPTION OF THE PREFERRED EMBODIMENTS

Figure 6:
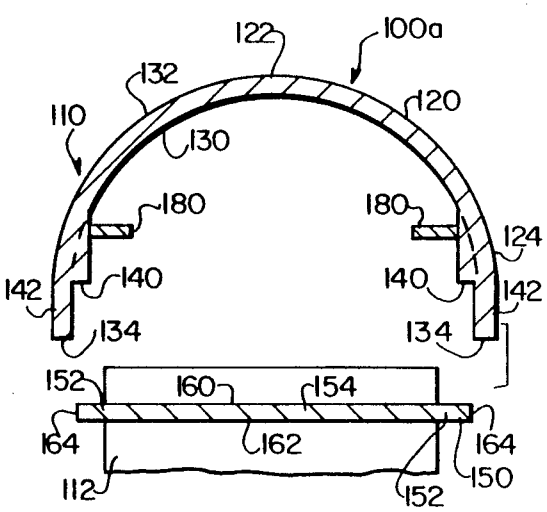
FIG. 6 is a cross-sectional view of the manifold and heat exchanger assembly of FIG. 3, with the tank and header plate unassembled.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalence which operate in a similar manner to accomplish a similar purpose.

Figure 6A:
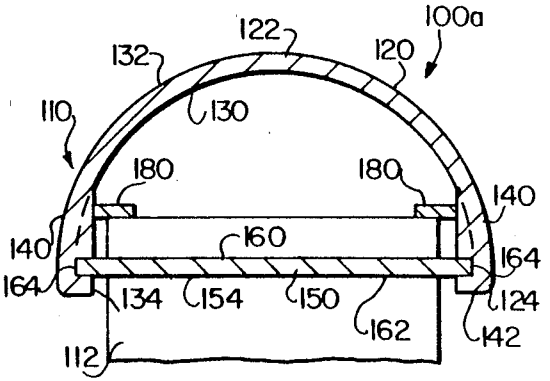
FIG. 6A is a cross-sectional view of the manifold and heat exchanger assembly of FIG. 3, taken along line 6A—6A of FIG. 3.

Referring now to FIGS. 3, 6, and 6A, there is shown a first embodiment of a manifold and heat exchanger assembly **100*a* in accordance with the present invention. Manifold and heat exchanger assembly 100*a* comprises a manifold assembly 110 into which are inserted a plurality of parallel condenser or evaporator tubes 112**.

Manifold assembly 110 comprises a unitary tank 120 having a substantially U-shaped cross-section and a unitary header plate 150 having a substantially planar cross-section. Thus, manifold assembly 110 has a substantially D-shaped cross-section. Tank 120 comprises an at least partially curved upper portion 122 which in cross-section forms the base of the U, a pair of substantially straight opposed, parallel sides 124 extending from the ends of upper portion 122 and which in cross-section form the arms of the U, an inner wall 130, an outer wall 132, and a pair of longitudinal end edges 134 extending between inner and outer walls 130 and 132 at the free ends of sides 124. A pair of opposed parallel longitudinal shelves 140 are formed in inner wall 130 inwardly of end edges 134 to define a pair of longitudinal flanges 140 extending from shelves 140.

Header plate 150 has length substantially equal to the length of tank 120 and comprises a pair of opposed, parallel longitudinal edge portions 152, a center portion 154 extending between edge portions 152, an upper wall 160, a lower wall 162, and a pair of longitudinal end edges 164 extending between upper and lower walls 160 and 162. Center portion 154 has a plurality of tube holes 170 formed therethrough for receiving tubes 112.

As shown in FIG. 6, header plate 150 is assembled to the ends of tubes 112. The ends of tubes 112 can be expanded into tube holes 170 prior to assembly of tank 120 to header plate 150. Tank 120 is then assembled to header plate 150 with upper wall 160 abutting or in close proximity to shelves 140, so that header plate 150 is inserted in tank 120 inwardly of end edges 134. As shown in FIG. 6A, flanges 142 are crimped to header plate 150 by folding flanges 142 over and around edge portions 152 of header plate 150.

Assembly of tank 120 with baffles 184 and header plate 150 can also be accomplished as a unit prior to assembly of manifold assembly 110 to tubes 112. Where, in certain brazing operations it is desired to use flux, the flux can be applied to the mating surfaces of the parts before their assembly. The prior art makes this operation very difficult.

Only a single manifold assembly is shown assembled to the tubes 120 in the Figures. However, it should be understood that in practice, a manifold assembly is assembled to tubes 120 at either end.

Tank 120 preferably is formed by extrusion. Header plate 150 preferably is formed by stamping, but also can be formed by extrusion. Tank 120 can be extruded from an aluminum alloy such as AA3003 or the like, while header plate 150 is fabricated from sheet aluminum of a desired base aluminum alloy such as AA3003 or the like, clad on both surfaces with aluminum alloy such as 4004, or other suitable brazing alloys.

Inner wall 130 of tank 120 can be formed with a pair of opposed, longitudinally-extending horizontal ribs 180 having pairs of opposed slots 182 therein for receiving baffles 184. Baffles 184 are substantially D-shaped in cross-section to form a tight fit with inner wall 130 of tank 120 and upper wall 160 of header plate 120. Horizontal ribs 180 can be formed to extend inwardly a sufficient amount to act as stops for tubes 112. Inner wall 130 of tank 120 can be coated with clad alloy in order to braze baffles 184 to inner wall 130.

In manifolds formed from circular or semi-circular tubes as shown in FIGS. 1 and 2, internal baffles must be installed from either end or through an external slot as shown in the Hoshino et al. patent. The use of the two-piece construction in accordance with the present invention allows installation of baffles 184 before assembly of tank 120 and header plate 150.

In general, tank 120, header plate 150, and baffles 184 are formed of aluminum and aluminum alloy materials suitable for brazing, at least one of the mating surfaces being fabricated with a lower temperature clad brazing material. For example, a lower cost extruded alloy can be used for tank 120, while a clad brazing sheet can be used for header plate 150. Thus, when tank 120, header plate 150, baffles 184, and tubes 112 are assembled, fixtured in place, and brazed in a high temperature brazing furnace, the clad material on header plate 150 provides the brazed material to braze tubes 112 to header plate 150, header plate 150 to tank 120, and baffles 184 to tank 120 and header plate 150.

Figure 4:
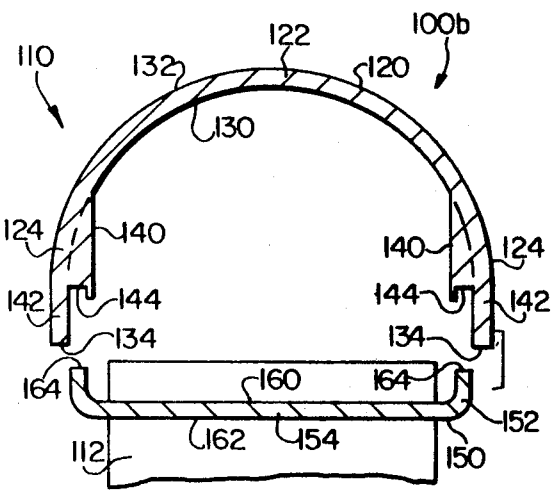
FIG. 4 is a cross-sectional view of a second embodiment of a manifold and heat exchanger assembly in accordance with the present invention, with the tank and header plate unassembled.
Figure 4A:
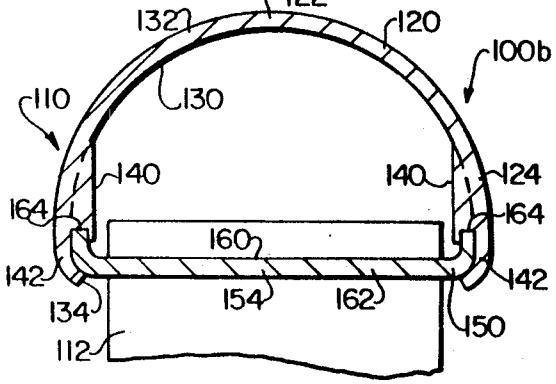
FIG. 4A is a cross-sectional view of the manifold and heat exchanger assembly of FIG. 4, with the tank and header plate assembled.

Referring now to FIGS. 4 and 4A, there is shown a second embodiment of a manifold and heat exchanger assembly **100*b* in accordance with the present invention. Manifold and heat exchanger assembly 100*b* is similar to manifold and heat exchanger 100*a* shown in FIGS. 3, 6, and 6A. However, the second embodiment, edge portions 152 of header plate 150 are upturned, and shelves 140 are formed With channels 144 for receiving upturned edge portions 152. Also, ribs 180 and baffles 184 as shown in FIG. 3 are omitted in the embodiment shown in FIGS. 4 and 4A, although if baffles 184 are desired, they can be provided as shown in FIG. 3**.

Figure 5:
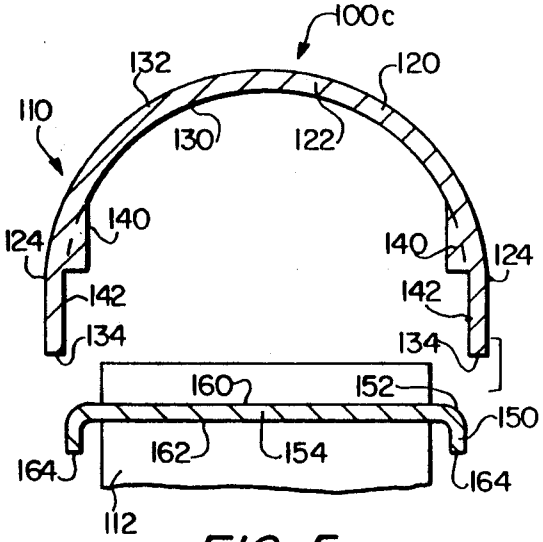
FIG. 5 is a cross-sectional view of a third embodiment of a manifold and heat exchanger assembly in accordance with the present invention, with the tank and header plate unassembled.
Figure 5A:
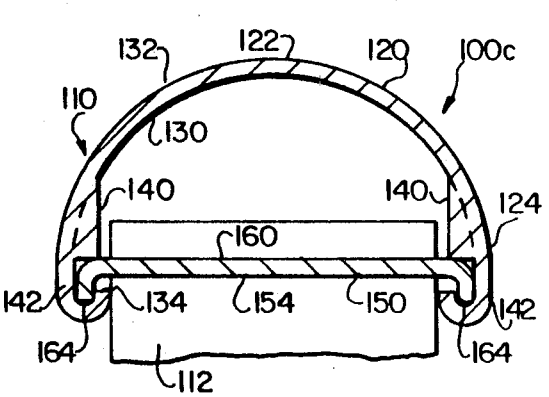
FIG. 5A is a cross-sectional view of the manifold and heat exchanger assembly of FIG. 5 with the tank and header plate assembled.

Referring now to FIGS. 5 and 5A, there is shown a third embodiment of a manifold and heat exchanger assembly **100*c* in accordance with the invention. The third embodiment is similar to the second embodiment shown in FIGS. 4 and 4A, except that edge portions 152 of header plate 150 are downturned, eliminating the need for channels 144 as shown in FIGS. 4 and 4A. Flanges 142 are hooked around downturned edged portions 152**.

Figure 7:
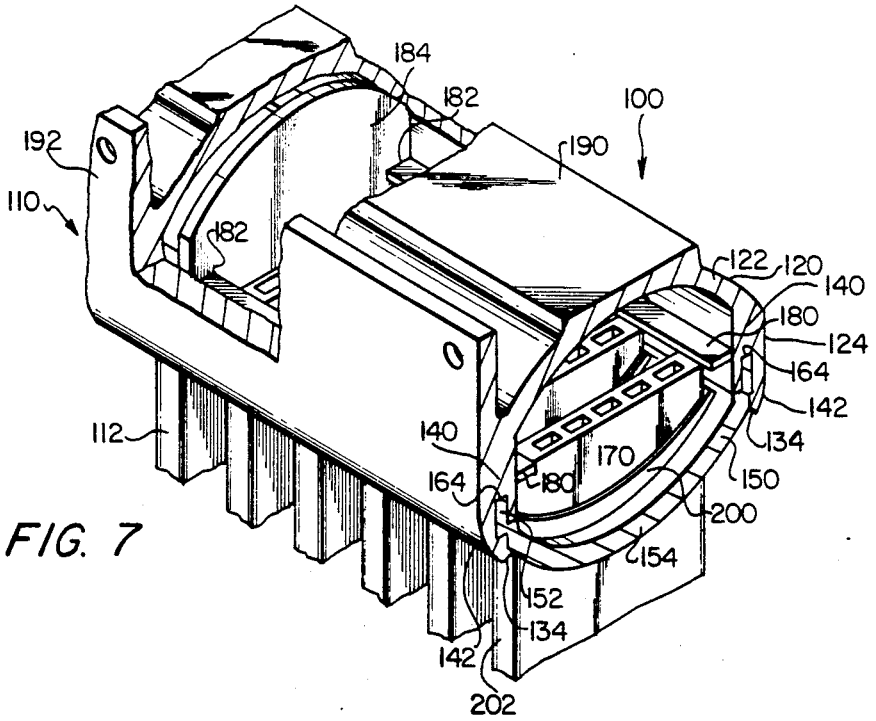
FIG. 7 is a perspective view, partially cut away, of a fourth embodiment of a manifold and heat exchanger assembly in accordance with the present invention.
Figure 8:
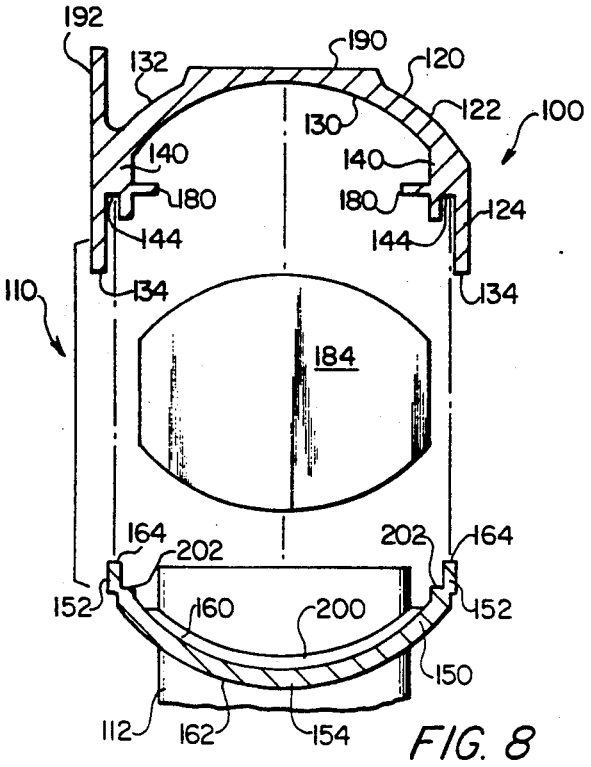
FIG. 8 is a cross-sectional view of the manifold and heat exchanger assembly of FIG. 7, with the tank, header plate, and baffles unassembled.
Figure 8A:
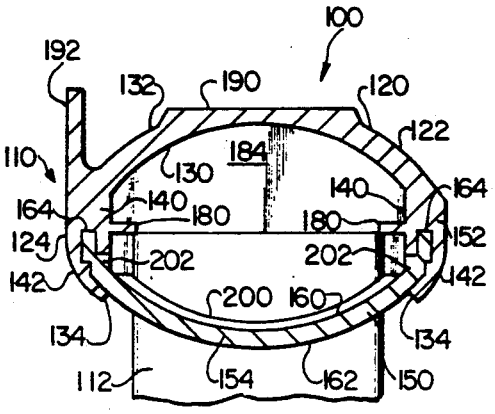
FIG. 8A is a cross-sectional view of the manifold and heat exchanger assembly of FIG. 7, taken along line 8A-8A of FIG. 7.

Referring now to FIGS. 7, 8, and 8A, there is shown a fourth embodiment of a manifold and heat exchanger assembly **100*d* in accordance with the present invention. In this embodiment, tank 120 has a central longitudinal ridge 190 formed on outer wall 132 and a mounting bracket 192 extending upwardly at one of sides 124. Also, header plate 150 has a substantially U-shaped cross-section with lips 200 formed around tube holes 170. Lips 200 are very uniform formed sections which follow th internal contour of header plate 150, allowing a precise tube-to-header fit. This precise tube-to-header fit in turn allows the braze to form a uniform fillet on lips 200**.

Inner wall 130 of tank 120 and upper wall 160 of header plate 150 can be provided with a plurality of opposed transverse indentations 201 positioned between tube holes 170, for receiving the upper and lower edges of baffles 184. Similar indentations 201 can be provided in inner wall 130 of tank 120 and upper wall 160 of header plate 150 of manifold and heat exchanger assemblies **100*a*–100*c* shown in FIGS. 3–6A**.

Preferably, indentations 201 are 0.020 inch deep. Baffles 184 have parallel, substantially planar side edges which are separated by a distance substantially equal to the distance between the parallel sides of the inner wall of the tank, and are connected by the opposed upper and lower edges, which are curved and concave, and of equal length. As will be recognized by those of skill in the art, baffles 184 will be sized to extend into indentations 201. Indentations 201 not only aid in positioning baffles 184, but also improve braze joint strength and reduce the potential for leakage after braze.

Longitudinal shelves 202 can be formed in header plate 150 for engaging the lower surface of shelves 140 of tank 120, and thus provide one means for sealing from baffle leakage around baffles 184. The use of a curved cross-section for both tank 120 and header plate 150 enables manifold assembly **100*d* to withstand higher internal pressures. Inner wall 130** can be spray clad for surface protection or brazing.

Referring now to FIG. 9, there is shown a fifth embodiment of a manifold and heat exchanger assembly **100*e*. This embodiment is similar to the fourth embodiment shown in FIGS. 7, 8 and 8A, in that tank 120 is provided with a mounting bracket 192, and header plate 150 has a substantially U-shaped cross-section and is provided with lips 200 formed around tube holes 170. However, in this embodiment, horizontal ribs 180 and baffles 184 are omitted. Instead, a longitudinally extending vertical rib 204 is formed along the center line of inner wall 130, and an inlet/outlet 210 is formed through curved upper portion 122 centered over vertical rib 204. Vertical rib 204 serves as a stop for tubes 112, and tubes 112 can have notches 212 formed in the ends thereof to engage vertical rib 204. This embodiment, with inlet/outlet 210 centered over vertical rib 204**, represents a single pass configuration of the present invention.

A sixth embodiment of a manifold and heat exchanger assembly **100*f* in accordance with the present invention is shown in FIG. 10, and illustrates how the single pass configuration shown in FIG. 9 can be altered to provide a two pass configuration. As shown in FIG. 10, a separate inlet 210*a* and outlet 210*b* can be provided on either side of vertical rib 204, and header plate 150 can be formed with an inwardly extending longitudinal ridge 220. Vertical rib 204 can then be brazed to upper wall 160 of header plate 150 at ridge 220** to provide a continuous center separator.

Figure 11:
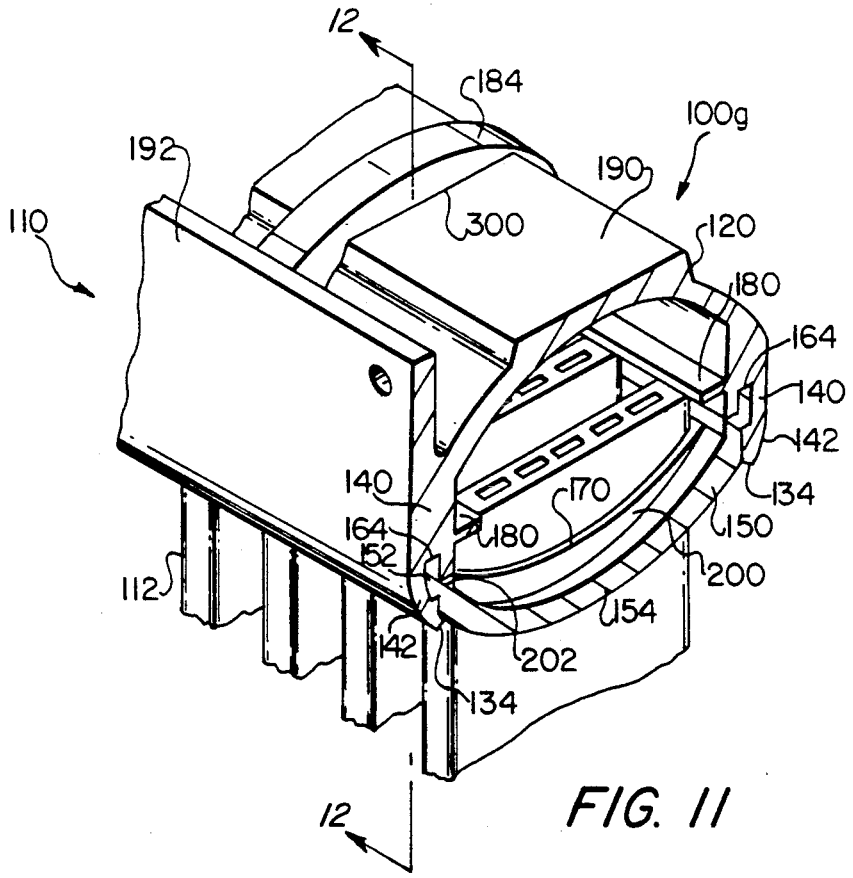
FIG. 11 is a perspective view of a seventh embodiment of a manifold and heat exchanger assembly in accordance with the present invention.
Figure 12:
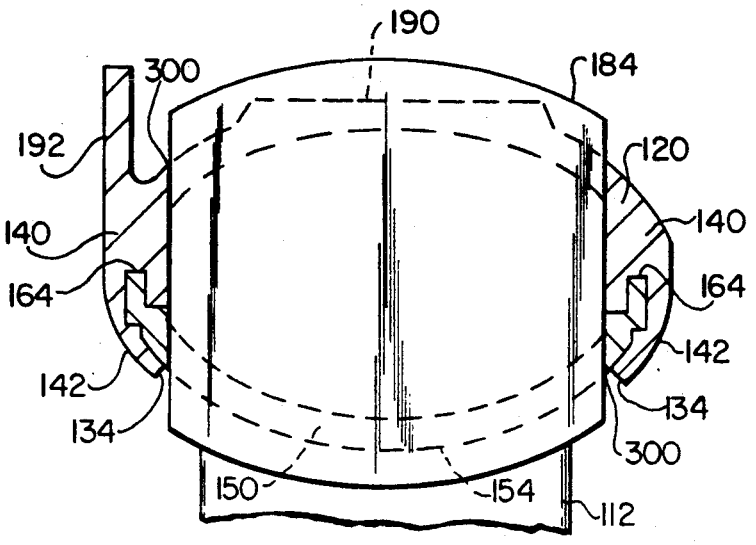
FIG. 12 is a cross-sectional view of the manifold and heat exchanger assembly of FIG. 11, taken along line 12—12 of FIG. 11.

Referring now to FIGS. 11 and 12, there is shown a seventh embodiment of a manifold and heat exchanger assembly 100*g* in accordance with the invention. The seventh embodiment is similar to the fourth embodiment shown in FIGS. 7, 8, and 8A, except that a plurality of opposed transverse slots 300 are provided in tank 120 and header plate 150, and baffles 184 extend outwardly of tank 120 and header plate 150 through slots 300. Preferably baffles 184 protrude approximately 0.020 inch to 0.095 inch from outer wall 132 of tank 120 and lower wall 162 of header plate 150. This configuration allows baffles 184 to be inserted after tank 120 and header plate 150 are assembled. It also allows better outgasing after vacuum brazing, as well as creating both internal and external brazed joints between baffles 184 and tank 120 and header plate 150. A higher burst pressure for the heat exchanger is thus achieved.

From the above, it is apparent that many modifications and variations of the present invention are possible in light of the above teachings. It is therefore to be understood that, within the scope of the appended claims, the invention may be practiced otherwise than as specifically described.

What is claimed is:

1. A manifold assembly for use with an internal pressure heat exchanger comprising a plurality of parallel tubes, said manifold assembly comprising:

a unitary tank having a substantially U-shaped cross-section, an inner wall, an outer wall, a plurality of parallel transverse slots formed therein, a pair of end edges extending between said inner and outer walls, and a pair of opposed parallel shelves formed in said inner wall inwardly of said end edges to define a pair of parallel longitudinally-extending flanges formed adjacent said end edges, said shelves having channels formed therein;

a unitary header plate having a substantially U-shaped cross-section, a length substantially equal to the length of said tank, an inner wall, an outer wall, a plurality of parallel, transverse tube holes formed therein, a plurality of parallel, transverse slots formed therein opposite said slots in said tank, and a pair of end edges extending between said inner and outer walls, said header plate being joined to said tank to define an interior space, and said end edges of said header plate being upturned and received in said channels in said tank; and a plurality of baffles inserted into said interior space through said opposed slots in said tank and said header plate, and extending outwardly of said outer walls of said tank and said header plate through said opposed slots;

said header plate and said tank being brazed together along substantially the entire lengths of their mating surfaces and said baffles being brazed to said tank and said header plate along the mating surfaces of said baffles and said inner and outer walls of said tank and said header plate; and said tank, said header plate, and said baffles being formed of aluminum and aluminum alloy materials suitable for furnace brazing, at least one of the mating surfaces of said tank, said header plate, and said baffles being fabricated with a lower temperature clad brazing material.

2. A manifold assembly for use with an internal pressure heat exchanger comprising a plurality of parallel tubes, said manifold assembly comprising:

a unitary tank having a substantially U-shaped cross-section, said tank comprising an upper portion which in cross-section forms the base of the U, a pair of substantially straight opposed, parallel sides extending from the ends of said upper portion and which in cross-section form the arms of the U, an inner wall, an outer wall, a plurality of parallel, transverse slots formed in said upper portion, and a pair of end edges extending between said inner and outer walls at the free ends of said sides, said sides adjacent said end edges forming a pair of parallel, longitudinally-extending flanges;

a unitary header plate having a substantially U-shaped cross-section and a length substantially equal to the length of said tank, said header plate comprising a lower portion which in cross-section forms the base of the U, a pair of substantially straight opposed, parallel sides extending from the ends of said lower portion and which in cross-section form the arms of the U, an inner wall, an outer wall, a plurality of parallel, transverse tube holes formed in said lower portion for receiving the tubes of the heat exchanger, a plurality of parallel, transverse slots formed in said lower portion opposite said slots in said tank, and a pair of end edges extending between said inner and outer walls at the free ends of said sides, said sides of said header plate being inserted in said tank inwardly of said end edges of said tank to define an interior space;

a plurality of baffles inserted into said interior space through said opposed slots in said tank and said header plate, and extending outwardly of said outer walls of said tank and said header plate through said opposed slots; and a pair of opposed parallel shelves formed in said inner wall inwardly of said end edges to define said flanges, said flanges extending from said shelves and said header plate being inserted in said tank with at least a portion of said header plate abutting said shelves of said tank;

said flanges of said tank being crimped inwardly to engage said header plate along at least the entire length thereof;

said end edges of said header plate being upturned and said shelves having channels formed therein for receiving said end edges of said header plate;

said header plate and said tank being brazed together along substantially the entire lengths of their mating surfaces and said baffles being brazed to said tank and said header plate along the mating surfaces of said baffles and said inner and outer walls of said tank and said header plate; and said tank, said header plate, and said baffles being formed of aluminum and aluminum alloy materials suitable for furnace brazing, at least one of the mating surfaces of said tank, said header plate, and said baffles being fabricated with a lower temperature clad brazing material.

3. The manifold assembly of claim 2, said header plate having lips formed therein around said tube holes.

4. A manifold assembly for use with an internal pressure heat exchanger comprising a plurality of parallel tubes, said manifold assembly comprising:

a unitary tank having a pair of opposed sides having free ends and a plurality of parallel transverse slots formed therein, said sides having defined at said free ends thereof longitudinally-extending flanges and having channels formed therein inwardly of said free ends;

a unitary header plate having a length substantially equal to the length of said tank and having a pair of opposed sides having free ends, a plurality of parallel transverse slots formed therein opposite said slots in said tank and a plurality of transverse tube holes formed therein for receiving the tubes of the heat exchanger, said sides being upturned at said free ends, and said free ends being inserted into said channels in said tank; and a plurality of baffles inserted between said tank and said header plate and extending outwardly of said tank and said header plate through said opposed slots;

said header plate being inserted in said tank inwardly of said free ends of said sides of said tank;

said flanges of said tank being crimped inwardly to engage said header plate along at least portions of the entire length thereof; and said tank, said header plate, and said baffles being formed of materials suitable for furnace brazing, at least one of said tank and said header plate being clad with brazing alloy, whereby when said tank and said header plate are brazed in a high temperature brazing furnace, the brazing alloy provides the material to braze said header plate to said tank and said header plate and said tank are brazed together along substantially the entire lengths of their mating surfaces.

5. A manifold assembly for use with an internal pressure heat exchanger comprising a plurality of parallel tubes, said manifold assembly comprising:

a unitary tank having a substantially U-shaped cross-section, an inner wall, an outer wall, a plurality of parallel transverse slots formed therein, and a pair of opposed, longitudinally-extending horizontal ribs having a plurality of opposed slots therein;

a unitary header plate having a substantially U-shaped cross-section, a length substantially equal to the length of said tank, an inner wall, an outer wall, a plurality of parallel, transverse tube holes formed therein, and a plurality of parallel, transverse slots formed therein opposite said slots in said tank, said header plate being joined to said tank to define an interior space; and a plurality of baffles inserted into said interior space through said opposed slots in said tank and said header plate, said baffles being received in said slots in said ribs and extending outwardly of said outer walls of said tank and said header plate through said opposed slots;

said header plate and said tank being brazed together along substantially the entire lengths of their mating surfaces and said baffles being brazed to said tank and said header plate along the mating surfaces of said baffles and said inner and outer walls of said tank and said header plate; and said tank, said header plate, and said baffles being formed of aluminum and aluminum alloy materials suitable for furnace brazing, at least one of the mating surfaces of said tank, said header plate, and said baffles being fabricated with a lower temperature clad brazing material.

6. A manifold assembly for use with an internal pressure heat exchanger comprising a plurality of parallel tubes, said manifold assembly comprising:

a unitary tank having a substantially U-shaped cross-section, said tank comprising an upper portion which in cross-section forms the base of the U, a pair of substantially straight opposed, parallel sides extending from the ends of said upper portion and which in cross-section form the arms of the U, an inner wall, an outer wall, a plurality of parallel, transverse slots formed in said upper portion, and a pair of end edges extending between said inner and outer walls at the free ends of said sides, said sides adjacent said end edges forming a pair of parallel, longitudinally-extending flanges;

a unitary header plate having a substantially U-shaped cross-section and a length substantially equal to the length of said tank, said header plate comprising a lower portion which in cross-section forms the base of the U, a pair of substantially straight opposed, parallel sides extending from the ends of said lower portion and which in cross-section form the arms of the U, an inner wall, an outer wall, a plurality of parallel, transverse tube holes formed in said lower portion for receiving the tubes of the heat exchanger, a plurality of parallel, transverse slots formed in said lower portion opposite said slots in said tank, and a pair of end edges extending between said inner and outer walls at the free ends of said sides, said sides of said header plate being inserted in said tank inwardly of said end edges of said tank to define an interior space;

a plurality of baffles inserted into said interior space through said opposed slots in said tank and said header plate, and extending outwardly of said outer walls of said tank and said header plate through said opposed slots; and a pair of opposed, longitudinally-extending horizontal ribs having a plurality of opposed slots therein for receiving said baffles;

said flanges of said tank being crimped inwardly to engage said header plate along at least the entire length thereof;

said header plate and said tank being brazed together along substantially the entire lengths of their mating surfaces and said baffles being brazed to said tank and said header plate along the mating surfaces of said baffles and said inner and outer walls of said tank and said header plate; and said tank, said header plate, and said baffles being formed of aluminum and aluminum alloy materials suitable for furnace brazing, at least one of the mating surfaces of said tank, said header plate, and said baffles being fabricated with a lower temperature clad brazing material.

7. A manifold assembly for use with an internal pressure heat exchanger comprising a plurality of parallel tubes, said manifold assembly comprising:

a unitary tank having a pair of opposed sides having free ends and a plurality of parallel transverse slots formed therein, said sides having defined at the free ends thereof longitudinally-extending flanges, and a pair of opposed, longitudinally-extending horizontal ribs having a plurality of opposed slots therein;

a unitary header plate having a length substantially equal to the length of said tank and having a plurality of parallel transverse slots formed therein opposite said slots in said tank and a plurality of transverse tube holes formed therein for receiving the tubes of the heat exchanger; and a plurality of baffles inserted between said tank and said header plate, said baffles being received in said slots in said ribs and extending outwardly of said tank and said header plate through said opposed slots;

said header plate being inserted in said tank inwardly of said free ends of said sides of said tank;

said flanges of said tank being crimped inwardly to engage said header plate along at least portions of the entire length thereof; and said tank, said header plate, and said baffles being formed of materials suitable for furnace brazing, at least one of said tank and said header plate being clad with brazing alloy, whereby when said tank and said header plate are brazed in a high temperature brazing furnace, the brazing alloy provides the material to braze said header plate to said tank and said header plate and said tank are brazed together along substantially the entire lengths of their mating surfaces.

8. A manifold assembly for use with an internal pressure heat exchanger comprising a plurality of parallel tubes, said manifold assembly comprising:

a unitary tank having a substantially U-shaped cross-section, an inner wall, an outer wall, and a plurality of parallel transverse slots formed therein, said inner wall having parallel, substantially planar sides;

a unitary header plate having a substantially U-shaped cross-section, a length substantially equal to the length of said tank, an inner wall, an outer wall, a plurality of parallel, transverse tube holes formed therein, and a plurality of parallel, transverse slots formed therein opposite said slots in said tank, said header plate being joined to said tank to define an interior space; and a plurality of baffles inserted into said interior space through said opposed slots in said tank and said header plate, said baffles having parallel, substantially planar side edges and a pair of opposed, curved, concave upper and lower edges of equal length connecting said side edges, said side edges being separated by a distance substantially equal to the distance between said parallel sides of said inner wall of said tank, and said end edges of said baffles extending outwardly of said outer walls of said tank and said header plate through said opposed slots;

said header plate and said tank being brazed to said tank and said header plate along the mating surfaces of said baffles and said inner and outer walls of said tank and said header plate; and said tank, said header plate, and said baffles being formed of aluminum and aluminum alloy materials suitable for furnace brazing, at least one of the mating surfaces of said tank, said header plate, and said baffles being fabricated with a lower temperature clad brazing material.

9. The manifold assembly of claim 8, said header plate having end edges, and said inner wall of said tank having channels formed therein receiving said edges of said header plate.

10. The manifold assembly of claim 8, said inner wall of said tank including a pair of opposed, longitudinally-extending horizontal ribs having a plurality of opposed slots therein for receiving said baffles.

* * * * *